United States Patent [19]

Scinta et al.

[11] Patent Number: 4,521,293

[45] Date of Patent: Jun. 4, 1985

[54] OIL RECOVERY

[76] Inventors: James Scinta; Theodore M. Classen, both of Ste. 1107, 1825 K St. N.W., Washington, D.C. 20006

[21] Appl. No.: 618,294

[22] Filed: Jun. 7, 1984

Related U.S. Application Data

[63] Continuation-in-part of Ser. No. 457,299, Jan. 11, 1983, abandoned.

[51] Int. Cl.[3] ..... C10G 1/04

[52] U.S. Cl. ..... 208/11 LE; 208/8 LE; 208/143; 208/144

[58] Field of Search ..... 208/11 LE, 8 LE, 11 R, 208/143, 144

[56] References Cited

U.S. PATENT DOCUMENTS

| | | | |
|---|---|---|---|
| 4,197,183 | 4/1980 | Audeh | 208/11 LE |
| 4,390,411 | 6/1983 | Scinta et al. | 208/11 LE |
| 4,397,736 | 8/1983 | Low | 208/11 LE |
| 4,438,816 | 3/1984 | Urban et al. | 208/11 LE |
| 4,449,586 | 5/1984 | Urban et al. | 208/11 LE |
| 4,461,696 | 7/1984 | Bock et al. | 208/11 LE |

FOREIGN PATENT DOCUMENTS

| | | | |
|---|---|---|---|
| 292280 | 8/1929 | Canada | 208/11 LE |
| 248014 | 3/1926 | United Kingdom | 208/11 LE |

*Primary Examiner*—Delbert E. Gantz
*Assistant Examiner*—A. Pal

[57] ABSTRACT

A process for upgrading carbonaceous materials having low carbon content comprising preheating the carbonaceous material to a temperature above about 200° C. in the absence of a solvent, extracting the heated carbonaceous material under moderate temperature and pressure conditions, and hydrotreating the extract under supercritical solvent conditions.

11 Claims, 1 Drawing Figure

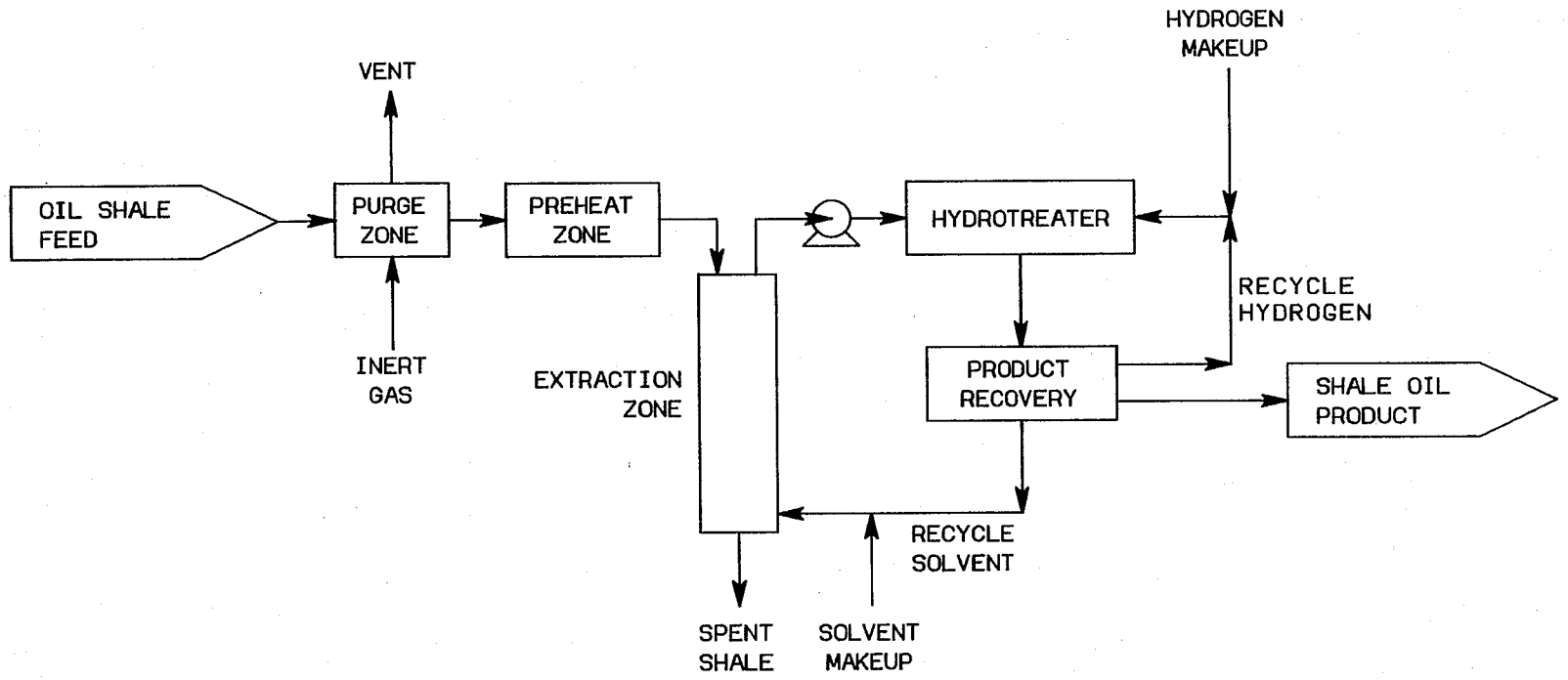
OIL SHALE FEED
VENT
PURGE ZONE
INERT GAS
PREHEAT ZONE
EXTRACTION ZONE
SPENT SHALE
SOLVENT MAKEUP
RECYCLE SOLVENT
HYDROTREATER
PRODUCT RECOVERY
HYDROGEN MAKEUP
RECYCLE HYDROGEN
SHALE OIL PRODUCT

OIL RECOVERY

This application is a continuation-in-part of co-pending application Ser. No. 457,299, filed Jan. 11, 1983, now abandoned.

BACKGROUND

Carbonaceous materials of low organic carbon content, such as tar sands and oil shale, are showing promise as sources of hydrocarbons.

Deposits of oil shale and tar sands have been found in parts of North America as well as in other regions of the world. These discoveries have sparked new scientific and commercial interest in finding practical methods for separating hydrocarbons from these mineral deposits and producing fuels and lubricants from the hydrocarbons.

OBJECTS OF THE INVENTION

It is one object of the invention to provide a process for recovering hydrocarbon values from carbonaceous materials of low organic carbon content.

It is another object of the invention by which hydrocarbons from such carbonaceous materials can be upgraded.

It is still another object of the invention to provide for the extraction and upgrading of hydrocarbons from low organic carbon deposits, such as tar sands and oil shales.

THE INVENTION

The invention provides a process for recovering shale oil by low-to moderate temperature heating in the absence of solvent, followed by low pressure solvent extraction and hydrotreatment of the extract under supercritical solvent conditions.

Further in accordance with the invention the process is provided for the recovery of hydrocarbon values from carbonaceous materials which comprise:

(1) preheating the carbonaceous material at a temperature of at least about 200° C. in the absence of a solvent, (2) subjecting the preheated material to solvent extraction in the presence of a volatile hydrocarbon solvent, and (3) hydrotreating the hydrocarbon extract under supercritical solvent conditions.

In one embodiment, crushed oil shale is heated to about 350°-500° C., held hot for about an hour, and solvent extracted with a hydrocarbon solvent, e.g., n-heptane, at relatively low pressure and temperature. The recovered extract is hydrotreated under supercritical solvent conditions. Solvent can be recovered for recycle to the extraction step.

ADVANTAGES

The processes disclosed herein have several advantages over known processes for hydrocarbon recovery from deposits having a low organic carbon content. Since the initial heating step takes place at atmospheric pressure or at relatively low pressure, the energy requirements of that operation are lower than those called for in conventional high-pressure heating steps, and the equipment required is simpler and less costly. Also since this process does not require the removal of oil as a vapor or entrained mist as in solids retorting, this process avoids oil refluxing problems and gives the operator greater freedom to set process conditions, thereby potentially improving thermal efficiency.

Applicants' initial heating step requires no solvent, thus the solids heating step can be carried out without concern about solvent loss. The presence of solvent in the subsequent treatment steps means that conventional methods for upgrading the hydrocarbons obtained, e.g., supercritical hydrotreating and hydrocracking can be easily carried out.

DESCRIPTION OF THE INVENTION

Low Organic Carbon Content Materials

By "low organic carbon content materials" is meant carbonaceous materials containing 25% or less or organic carbon. Suitable materials include oil shale, tar sands, oil sands, and similar deposits. Coal, lignite, and other materials which contain more than 25% organic carbon are not suitable.

THE DRAWING

The block flow diagram shows a preferred embodiment of the invention. Carbonaceous material, e.g., raw ground shale, preferably crushed to about 4 mesh or finer, is optionally purged to eliminate air. Inert gas, steam, or product gas from a parallel heating train may be used for this purge. The purged feed is then heated to a low to moderate temperature and held at that temperature for a time sufficient to facilitate the release of hydrocarbons therefrom.

During the preheating step the pressure can be allowed to build up, in which event it is preferred that volatiles be flashed off before low pressure extraction. Alternatively, the volatiles are bled off during heating. The product vapors are cooled, and any condensate is either taken off as a separate product, added to the extraction zone, or combined with extract product. It is believed that the heating step effects at least partial decomposition of the kerogen and thereby makes it more amenable to solvent extraction.

Solvent extraction is preferably carried out at nominal pressure, i.e., on the order of 20 psia (138 kPa) or higher. Extraction temperatures are preferably in the range of about 100° to about 300° F. (about 38°-150° C.), the higher temperatures generally being preferred for higher boiling solvents. The extraction may be carried out in any equipment suitable for contacting solids and liquids in either batch or continuous modes. It is preferred to conduct the extraction in a countercurrent manner such as in a columnar contactor. If conducted continuously, solids are introduced at the top and solvent passes upflow through the bed.

Following extraction, spent shale is removed and the extract is hydrotreated and the upgraded product and hydrogen then recovered. During hydrotreatment, hydrogen gas from an outside, or make-up, source as well as hydrogen from recycle of the gas recovered along with the product can be employed.

The product recovery operation will yield solvent, which can be recycled, with the optional addition of make-up solvent, to the extraction zone.

THE HEATING STEP

Initial heating takes place at low to moderate pressure in the absence of a solvent or diluent. Pressures ranging from atmospheric to 200 psia are operable. The pressure may be released at various times during the heating step, or may be bled off continuously, e.g., via a back pressure controller.

The temperature to which the carbonaceous feed is heated depends upon various factors. Among them is the character of the feed, its particle size, and the physical limitations of the heating zone. In general, low to moderate temperatures on the order of at least about 200° C. and often about 200° to about 750°, preferably about 350° to about 500° C., are employed.

The duration of the solventless heating step is not critical. In general any duration which assists in the release of a significant portion of the hydrocarbons from the feed is operable. However, heating times of about 5 to about 300 minutes, preferably about 10 to about 60 minutes, are generally operable. Heating times of about ½ hour to about 2 hours are highly preferred.

An optional purging step, using conventional gases and procedures, can precede the heating step.

THE SOLVENT EXTRACTION

The solvent extraction step which follows the heating step is also conducted at relatively low pressure. Operable pressures include about atmospheric to about 500 psia, with about 20 psia to about 100 psia preferred.

The type of extraction vessel used is not critical. Any apparatus which affords adequate contact between the heated carbonaceous material and the solvent being used as extractant is operable. Suitable apparatuses include batch and continuous solid-liquid contactors which may be mechanically agitated to enhance mass transfer or suitably baffled to minimize channeling.

Solvent/shale weight ratios of about 0.25:1 to about 15:1 are operable, with a range of about 0.5:1 to about 5:1 preferred. Contact times of 5–300 min. are operable, with a range of 10–60 min. preferred.

Suitable solvents include alkanes, cycloalkanes and selected aromatic hydrocarbons.

The preferred extractants and hydrotreating medium are generally alkanes i.e., paraffins. The alkanes contain between 2 and 20 carbon atoms and are aliphatic, branched, or cyclic. Alkanes having 4 to 10 carbons including normal alkanes, such as n-pentane, n-hexane, n-heptane, n-octane, n-nonane, n-decane, and cycloalkanes, such as cyclohexane and methylcyclohexane are preferred. N-heptane is most preferred. Mixtures of alkanes can be used. Alternatively, the hydrotreating medium can comprise a mixture of alkanes and aromatic compounds. Suitable aromatic compounds are benzene, toluene, xylene, napthalene, or substituted forms thereof.

In a preferred embodiment, a mixture of one or more aromatic solvents and one or more structurally related paraffins, i.e., cycloaliphatic solvents is employed. The term "structurally related paraffins" refers to saturated compounds whose configurations are analogous to one or more of the aromatic solvents used. Suitable mixtures contain benzene or its substituted derivatives in combination with cyclohexane or its substituted derivatives. Useful cosolvent combinations include benzene and cyclohexane; toluene and methylcylohexane; and xylenes and dimethylcyclohexanes. A mixture comprising toluene and methylcyclohexane is preferred.

When combinations of aromatic and structurally related paraffin solvents are employed, the concentration of paraffin solvent therein will range from 2 to 10 weight percent, with 5 to 10 weight percent preferred.

Reclaimed solvents boiling at temperatures under 150° C. are also operable.

No provision need be made for the removal of extractant or solvent before the hydrogenation step. The extractant remains in the system during hydrogenation.

It is also within the scope of the invention to adjust the solvent composition after the extraction step. For example, a portion of the solvent might be removed by flashing or distillation, or the extract might be diluted to accommodate the preferred hydrotreating conditions. The extraction step, for example, can be carried out with toluene and the extract then diluted with about 10 weight percent methylcyclohexane to obtain preferred hydrotreating conditions.

THE HYDROGENATION STEP

The hydrogenation or hydrotreating operation is carried out by contacting the material to be treated with hydrogen, preferably in the presence of at least one catalyst. The hydrogen can be introduced along with the extracting fluids, during the extraction step, or between the extraction and hydrogenation steps.

The hydrogenation will take place in the presence of the supercritical extractant.

Useful catalyst for the hydrogenation operation include Groups VIb, VII, and VIII metals, their oxides and salts. Suitable metals are tungsten, cobalt, molybdenum, nickel, iron, platinum, and palladium. Combinations of two or more metals may also be used. A nickel-molybdenum combination, such as Nalco Ni-Mo catalyst is preferred.

The catalyst employed may be on a suitable carrier during use. Useful carriers include alumina, silica, silica-alumina, metal oxides, and mixtures of metal oxides.

The catalyst and support may be sulfided or unsulfided.

The hydrogenation step takes place under controlled conditions of temperature, pressure, and hydrogen rate. The temperature used is generally from 200° to 475° C. with 250°–425° C. preferred. The pressure used will vary from 750 to 10,000 psig and will preferably be about 1,000–3,000 psig. The hydrogen rate used is between 100 and 10,000 scf/bbl., preferably 500–2,500 scf/bbl of fluid treated.

The hydrogenation step produces a mixture of hydrocarbons having less than 0.05% sulfur and less than 0.3% nitrogen. When solvent extracted oil shale is hydrogenated in accordance with the invention, the resultant product will typically contain 0.01% or less of sulfur and 0.02% or less of nitrogen.

In combination with the hydrogenation step, other conventional operations, such as desulfurization or retorting, may be employed.

The solids and fluids produced can be separated by conventional methods. Useful devices include cyclones, filters, settling devices, or combinations thereof.

The fractions with the fluid phase can be separated via one or more conventional cooling, pressure reduction, or distillation steps. Cobmined methods are also operable.

PRODUCT RECOVERY

The hydrocarbon extract can be separated from the extraction solvent via a variety of techniques. Suitable techniques include flashing, stripping, distillation, and vacuum evaporation. Combinations of techniques can be employed.

SUBSEQUENT TREATMENT

Following the heating, extraction, and hydrogenation steps discussed above, the hydrocarbon product can be subjected to one or more conventional upgrading procedures such as coking, visbreaking, catalytic or non-catalytic hydrotreating.

EXAMPLE I

A series of laboratory runs were made in which 500 g charges of −7 mesh Utah oil shale with 32 gal/ton Fischer assay were heated to about 400° C., held at that temperature for one hour, cooled to about 100° C., and solvent extracted at that temperature by pumping solvent through the vessel at the rate of about 10 ml/min. The entire operation was carried out at substantially atmospheric pressure. Product extract was recovered by distillation and evaporation under vacuum.

| Ex. | Solvent | Extract Recovery, % of Fischer Assay | Extract Solvent, mL | Solvent/ Shale Wt. Ratio |
|---|---|---|---|---|
| 1 | toluene | 53.5 | 1036 | 1.8 |
| 2 | " | 66.7 | 8566 | 15.0 |
| 3 | " | 94.5 | 8215 | 14.3 |
| 4 | " | 100.3 | 7532 | 12.7 |
| 5 | " | 81.0 | 7720 | 13.5 |
| 6 | " | 65.1 | 7584 | 13.2 |
| 7 | n-heptane toluene | 63.0 | 8217 | 11.3 |
| 8 | " | 56.2 | 8217 | 11.3 |

Variability of the results is believed to be due primarily to differences in the shale samples (the ore was not blended). The first run was prematurely shortened when the extract filter line plugged with shale fines. On subsequent runs, fines were separated from the ore before extraction.

Since the contacting of treated shale with solvent in the extraction step was rather crude, it estimated that solvent requirements can be considerably reduced when a more efficient multistage contactor is used.

EXAMPLE II

A series of laboratory runs were made in which 500 G charges of ¼ by ⅛ inch Utah oil shale were heated to various temperatures in nitrogen, held at that temperature for one hour, cooled to about 100 C., and solvent extracted at that temperature by pumping toluene through the vessel at the rate of about 10 ml/min. The entire operation was carried out at substantially atmospheric pressure. Product extract was recovered by distillation and evaporation under vacuum.

The results of these runs are given in the following table.

| Ex | Temperature (C) | Extract Recovery (lb Oil/lb Shale) |
|---|---|---|
| 1 | 177 | 0.0176 |
| 2 | 260 | 0.0158 |
| 3 | 343 | 0.0250 |

-continued

| Ex | Temperature (C) | Extract Recovery (lb Oil/lb Shale) |
|---|---|---|
| 4 | 400 | 0.1446 |

It is clearly shown that heating at a temperature above 350 C provides a significant increase in oil yield for this shale.

Reasonable variations, such as those which would occur to the skilled artisan, may be made herein without departing from the scope of the invention.

That which is claimed is:

1. A process for the recovery of hydrocarbons from oil shale containing said hydrocarbons comprising the steps of:

(1) heating said oil shale to a temperature of at least about 200° C. and at a low to moderate pressure ranging from atmospheric to 200 psia in the absence of a solvent or diluent to effect at least partial decomposition of the kerogen and the release of a significant portion of the hydrocarbons from the oil shale, (2) contacting the heated oil shale in a countercurrent manner with a hydrocarbon solvent comprising alkanes and cycloalkanes having from 4–10 carbon atoms and aromatic compounds selected from benzene, toluene, xylene, naphthalene, substituted forms thereof, and mixtures thereof at a pressure from about atmospheric to about 500 psia and a temperature in the range of from about 100° to about 300° F. (38°–150° C.) for about 10 to about 300 minutes to yield a hydrocarbon extract, and (3) hydrotreating the hydrocarbon extract of step (2) under supercritical solvent conditions.

2. The process of claim 1 additionally comprising the step of:

(4) recovering and recycling the solvent from step (3) to step (2).

3. The process of claim 2 wherein the solvent employed in step (2) is n-heptane or toluene or mixtures thereof.

4. The process of claim 3 wherein the solvent is toluene and the extraction takes place at a temperature of about 38° C. to about 150° C.

5. The process of claim 3 containing the additional step of:

(4) recovering and recycling the solvent from step (3) to step (2).

6. The process of claim 4 including the additional step:

(4) recovering and recycling the solvent from step (3) to step (2).

7. The process of claim 6 wherein the product of step (3) is further treated to yield a fuel.

8. The process of claim 7 wherein the process of step (3) is further treated to yield a lubricant.

9. A process according to claim 1 wherein preheating in step (1) is carried out at a temperature in the range of about 200° C. to 750° C.

10. A process according to claim 9 wherein preheating the step (1) is carried out at a temperature in the range of about 350° C. to 500° C.

11. A process according to claim 9 wherein the solvent is n-heptane or toluene or mixtures thereof.

* * * * *

UNITED STATES PATENT AND TRADEMARK OFFICE

CERTIFICATE OF CORRECTION

PATENT NO. : 4,521,293

DATED : June 4, 1985

INVENTOR(S) : James Scinta and Theodore M. Classen

It is certified that error appears in the above-identified patent and that said Letters Patent is hereby corrected as shown below:

On the title page;
Assignee should be: Phillips Petroleum Company
Bartlesville, Oklahoma Signed and Sealed this

*Thirteenth* Day of *August 1985*

[SEAL]

*Attest:*

DONALD J. QUIGG

*Attesting Officer* *Acting Commissioner of Patents and Trademarks*